US010295938B2

(12) United States Patent
Kato et al.

(10) Patent No.: US 10,295,938 B2
(45) Date of Patent: May 21, 2019

(54) SEPARATOR, FIXING DEVICE, AND IMAGE FORMING APPARATUS

(71) Applicants: Shinichi Kato, Tokyo (JP); Kenji Maeda, Kanagawa (JP); Hirochika Ohnishi, Kanagawa (JP)

(72) Inventors: Shinichi Kato, Tokyo (JP); Kenji Maeda, Kanagawa (JP); Hirochika Ohnishi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 122 days.

(21) Appl. No.: 15/670,105

(22) Filed: Aug. 7, 2017

(65) Prior Publication Data

US 2018/0059599 A1 Mar. 1, 2018

(30) Foreign Application Priority Data

Sep. 1, 2016 (JP) ..... 2016-170552
May 11, 2017 (JP) ..... 2017-094505

(51) Int. Cl.
*G03G 15/20* (2006.01)

(52) U.S. Cl.
CPC ..... *G03G 15/2028* (2013.01); *G03G 15/2053* (2013.01)

(58) Field of Classification Search
CPC ..... G03G 15/2028; G03G 15/6532
USPC ..... 399/107, 110, 122, 320, 322, 323, 399/397–399
See application file for complete search history.

(56) References Cited

U.S. PATENT DOCUMENTS 7,149,463 B2 * 12/2006 Fujisawa ..... G03G 15/2028 399/323
8,938,181 B2 * 1/2015 Suzuki ..... G03G 21/206 399/98
2009/0238615 A1 9/2009 Katabami et al.
2016/0124361 A1 5/2016 Watanabe et al.
2016/0209789 A1 7/2016 Nozawa et al.

FOREIGN PATENT DOCUMENTS

JP 2001-235959 8/2001
JP 2003-122174 4/2003
JP 2005-181999 7/2005
(Continued)

OTHER PUBLICATIONS

U.S. Appl. No. 15/410,260, filed Jan. 19, 2017.

*Primary Examiner* — Hoan H Tran
(74) *Attorney, Agent, or Firm* — Oblon, McClelland, Maier & Neustadt, L.L.P.

(57) ABSTRACT

A separator includes a base and a sheet. The base includes a first face to face a medium, a second face being opposite to the first face, and a third face being an end face in a longitudinal direction of the base. The sheet is disposed on a portion of each of the first and second faces that contacts or is adjacent to a rotator. The sheet has a length in a longitudinal direction thereof substantially equal to a length of the base in the longitudinal direction thereof. The sheet includes a projecting portion outboard from the length of the sheet in the longitudinal direction thereof. A combined length of the sheet and the projecting portion in the longitudinal direction of the sheet is greater than the length of the base in the longitudinal direction thereof. The projecting portion is attached to the second and third faces of the base.

9 Claims, 9 Drawing Sheets

(56) References Cited

FOREIGN PATENT DOCUMENTS

| | | |
|---|---|---|
| JP | 2006-171551 | 6/2006 |
| JP | 2011-008103 | 1/2011 |
| JP | 2011-043763 | 3/2011 |
| JP | 2012-042787 | 3/2012 |
| JP | 2014-048440 | 3/2014 |
| JP | 2016-061949 | 4/2016 |
| JP | 2016-118785 | 6/2016 |

* cited by examiner

SEPARATOR, FIXING DEVICE, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2016-170552, filed on Sep. 1, 2016, and 2017-094505, filed on May 11, 2017, in the Japan Patent Office, the entire disclosure of each of which is hereby incorporated by reference herein.

BACKGROUND

Technical Field

Embodiments of the present disclosure relate to a separator, a fixing device incorporating the separator, and an image forming apparatus incorporating the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, an image is formed on the recording medium.

Such a fixing device typically includes a fixing rotator, such as a roller, a belt, and a film, and a pressure rotator, such as a roller and a belt, pressed against the fixing rotator. The fixing rotator and the pressure rotator apply heat and pressure to the recording medium, melting and fixing the toner image onto the recording medium while the recording medium is conveyed between the fixing rotator and the pressure rotator.

The fixing device may further include a separator to smoothly separate the recording medium bearing the fixed toner image from the fixing rotator or the pressure rotator. The separator can be in line contact with the fixing rotator or the pressure rotator. For example, the separator is a metal board with a fluororesin sheet or film attached via a silicone adhesive.

SUMMARY

In one embodiment of the present disclosure, a novel separator for separating a medium from a rotator is described. The separator includes a base and a sheet. The base includes a first face to face the medium, a second face being opposite to the first face, and a third face being an end face in a longitudinal direction of the base. The sheet is disposed on a portion of each of the first face and the second face that contacts or is adjacent to the rotator. The sheet has a length in a longitudinal direction of the sheet substantially equal to a length of the base in the longitudinal direction of the base. The sheet includes a projecting portion outboard from the length of the sheet in the longitudinal direction of the sheet. A combined length of the sheet and the projecting portion in the longitudinal direction of the sheet is greater than the length of the base in the longitudinal direction of the base. The projecting portion is attached to the second face and the third face of the base.

Also described are a novel fixing device incorporating the separator and a novel image forming apparatus incorporating the fixing device.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
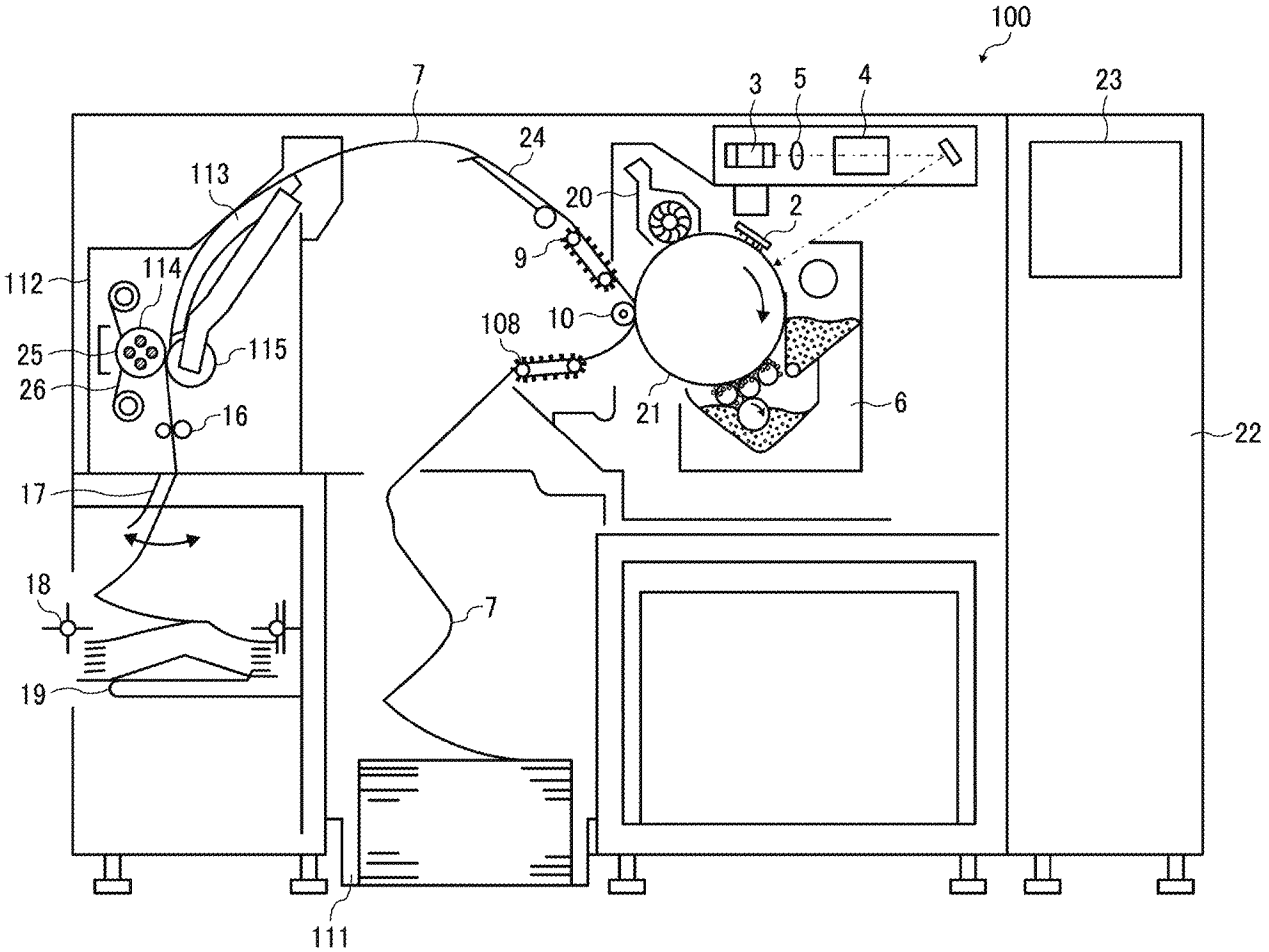
FIG. 1 is a schematic view of a first example of an image forming apparatus according to an embodiment of the present disclosure.

In describing embodiments illustrated in the drawings, specific terminology is employed for the sake of clarity.

However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, M, C, and K denote colors yellow, magenta, cyan, and black, respectively. To simplify the description, these suffixes are omitted unless necessary.

Referring now to the drawings, embodiments of the present disclosure are described below.

According to an embodiment, a separator (e.g., separator 1) separates a medium (e.g., sheet 7) from a rotator (e.g., fixing roller 114). The separator includes a base (e.g., base 1A) and a sheet (e.g., resin sheet). The base includes a first face (e.g., first face 11), a second face (e.g., second face 12), and a third face (e.g., third face 13). The first face faces the medium. The second face is opposite to the first face. The third face is an end face of each of opposed end portions of the base in a longitudinal direction thereof. The sheet is disposed on a portion of each of the first face and the second face that contacts or is adjacent to the rotator. A length of the sheet in a longitudinal direction thereof, herein referred to as a width of the sheet, is substantially equal to a length of the base in the longitudinal direction thereof, herein referred to as a width of the base. The sheet includes a projecting portion (e.g., projecting portion 1B2) outboard from the width of the sheet. A combined length of the sheet and the projecting portion is greater than the width of the base, that is, the length of the sheet in the longitudinal direction thereof. The projecting portion is attached to the second face and the third face of the base. As described above, the sheet is attached to the portion of each of the first face and the second that contacts or is adjacent to the rotator.

More specifically, when the sheet contacts the rotator, one side of the sheet makes a line contact with the rotator with respect to an axial direction of the rotator. When the sheet is adjacent to the rotator, one side of the separator is disposed adjacent to the rotator to prevent the medium from being wrapped around the rotator.

The rotator is a fixing rotator, for example. The fixing rotator fixes toner as a developer onto the medium (e.g., recording medium) by heat and pressure. The fixing rotator may be a roller, a film, a belt, or the like provided that the fixing rotator is capable of contacting the medium. For example, the fixing rotator is a fixing roller. Alternatively, the rotator may be a pressure rotator, such as a pressure roller, that presses the recording medium against the fixing rotator.

As described above, the third face is an end face of each of the opposed end portions of the base or the separator in the longitudinal direction thereof. In some embodiments, the third face may be an edge side of an end portion of the separator in the longitudinal direction thereof.

Figure 2:
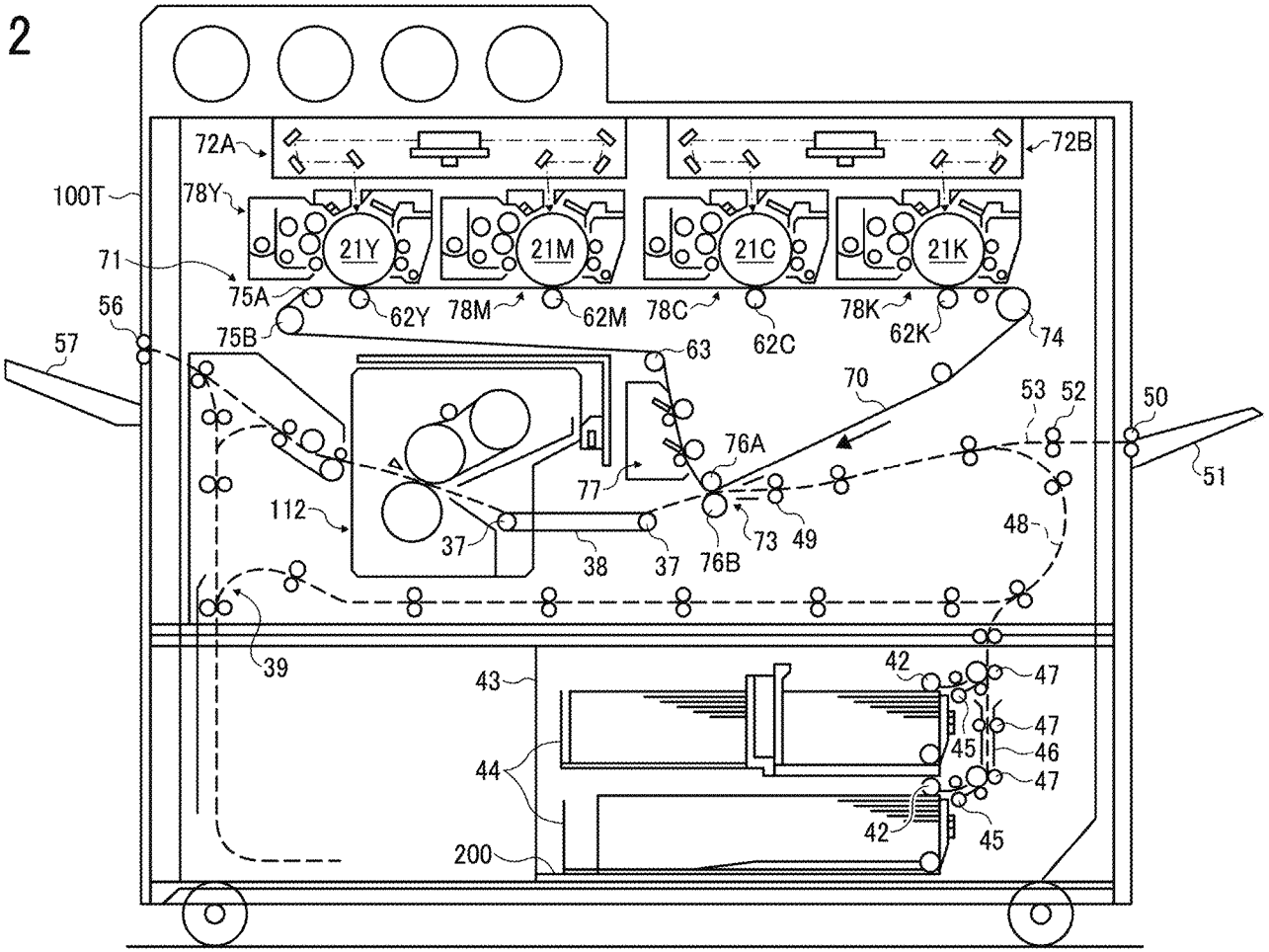
FIG. 2 is a schematic view of a second example of the image forming apparatus.

Referring now to FIGS. 1 and 2, a description is given of some examples of an electrophotographic image forming apparatus according to an embodiment of the present disclosure.

The image forming apparatus may be a copier, a facsimile machine, a printer, a multifunction peripheral or multifunction printer (MFP) having at least one of copying, printing, scanning, facsimile, and plotter functions, or the like. The image forming apparatus forms color and monochrome toner images on a recording medium by electrophotography. Alternatively, the image forming apparatus may form a monochrome toner image on a recording medium by electrophotography.

Initially with reference to FIG. 1, a description is given of an overall construction of a first example of the image forming apparatus.

FIG. 1 is a schematic view of an image forming apparatus 100.

The image forming apparatus 100 includes, e.g., a controller 22 and a photoconductor drum 21 as an image bearer to bear a latent image and a toner image thereon. The photoconductor drum 21 rotates in a clockwise direction as indicated by an arrow in FIG. 1, according to a signal from the controller 22 to start a print job. The photoconductor drum 21 rotates at a speed corresponding to a printing speed of the image forming apparatus 100. The photoconductor drum 21 continues rotating until the print job ends. When the photoconductor drum 21 starts rotation, a high voltage is applied to a corona charger 2. The corona charger 2 uniformly charges the surface of the photoconductor drum 21. For example, the corona charger 2 uniformly applies positive electric charges onto the surface of the photoconductor drum 21.

A polygon mirror 3 starts rotating immediately after the image forming apparatus 100 is supplied with power. Rotation of the polygon mirror 3 remains at a certain speed accurately while the image forming apparatus 100 is supplied with power. A light source 4, such as a semiconductor laser, emits light. The polygon mirror 3 reflects the light emitted by the light source 4. The light then passes through an f-θ lens 5 and reaches the photoconductor drum 21. That is, the surface of the photoconductor drum 21 is irradiated with the light, thus being scanned. The controller 22 transmits text or graphic data converted into a dot image as an on/off signal of laser beams of light. According to the signal, the surface of the photoconductor drum 21 is partly irradiated with the laser beams, removing the charges from the irradiated portion of the surface of the photoconductor drum 21. Thus, an electrostatic latent image is formed on the surface of the photoconductor drum 21.

When the electrostatic latent image on the surface of the photoconductor drum 21 reaches a position where the electrostatic latent image faces a developing device 6, the electrostatic latent image is supplied with toner. The toner (e.g., positively charged toner) adheres to the electrostatic latent image (i.e., the portion of the surface of the photoconductor drum 21 from which the charges are removed by being irradiated with the laser beams) by static electricity, rendering the electrostatic latent image visible as a toner image. Thus, a toner image is formed on the photoconductor drum 21.

In a lower portion of the image forming apparatus 100 is a sheet hopper 111 that accommodates a continuous sheet 7 as a recording medium. Activation of a sheet conveyor tractor 108 is timed to convey the sheet 7 from the sheet hopper 111 to a transfer area between the photoconductor drum 21 and a transfer device 10 such that the toner image formed on the photoconductor drum 21 meets the sheet 7 at the transfer area. At the transfer area, the toner image is transferred from the photoconductor drum 21 to the sheet 7. Specifically, the transfer device 10 applies charges having a polarity opposite a polarity of toner contained in the toner image to a back side of the sheet 7 so that the toner image is transferred onto a front side of the sheet 7.

Then, a sheet conveyor tractor 9 sends the sheet 7 bearing the toner image to a fixing device 112 via a buffer plate 24. That is, the sheet 7 is conveyed from the sheet hopper 111 to the fixing device 112 via the sheet conveyor tractor 108, the transfer device 10, the sheet conveyor tractor 9, and the buffer plate 24. The fixing device 112 includes a preheater 113, a fixing roller 114, and a pressure roller 115. The preheater 113 accommodates a plurality of heaters. The fixing roller 114 accommodates a heater 25, which is, e.g., a lamp. In the fixing device 112, the preheater 113 preheats the sheet 7. Then, the fixing roller 114 and the pressure roller 115 apply heat and pressure to the sheet 7 while conveying the sheet 7 through an area of contact, herein referred to as a fixing nip, between the fixing roller 114 and the pressure roller 115. The toner contained in the toner image is melted by heat and pressed against the sheet 7. Thus, the toner image is fixed onto the sheet 7 while the sheet 7 is conveyed through the fixing nip. In the present example of FIG. 1, the fixing device 112 includes the preheater 113. Alternatively, the preheater 113 may be excluded depending on output of the heater 25.

After the toner image is fixed onto the sheet 7, the sheet 7 conveyed by the fixing roller 114 and the pressure roller 115 reaches a sheet conveyor roller 16. The sheet conveyor roller 16 sends out the sheet 7 toward a stacker table 19. On the way to the stacker table 19, a swing fin 17 swings to fold the sheet 7 along a stitch perforation alternately. A paddle 18 adjusts folding conditions while rotating. Finally, the sheet 7 rests on the stacker table 19. FIG. 1 illustrates a cleaner 20 that cleans the surface of the photoconductor drum 21 passing through the transfer area after the toner image is transferred from the photoconductor drum 21 onto the sheet 7. Specifically, the cleaner 20 removes residual toner from the surface of the photoconductor drum 21, rendering the photoconductor drum 21 ready for a next print job. It is to be noted that the residual toner is toner failed to be transferred from the photoconductor drum 21 onto the sheet 7 and therefore remaining on the photoconductor drum 21.

The buffer plate 24, described above, adjusts a stretching condition of the sheet 7. Specifically, when a speed difference to convey the sheet 7 is caused between the sheet conveyor tractor 9 and the fixing roller 114 and the pressure roller 115, the buffer plate 24 absorbs slack or tension from the sheet 7. FIG. 1 further illustrates a display 23 (e.g., screen) that displays information based on a status of the image forming apparatus 100 engaged in a print job. In the fixing device 112 is a web 26 that can be wound. The web 26 is disposed to contact the surface of the fixing roller 114 to apply a toner release agent or a lubricant to the surface of the fixing roller 114.

Referring now to FIG. 2, a description is given of an overall construction of a second example of the image forming apparatus.

FIG. 2 is a schematic view of an image forming apparatus 100T.

The image forming apparatus 100T employs a tandem structure in which a plurality of image forming devices for forming toner images in different colors is aligned. The image forming apparatus 100T also employs an intermediate transfer structure in which a toner image is transferred onto a recording medium via an intermediate transfer belt from a photoconductor. In a lower portion of the image forming apparatus 100T is a sheet feeding table 200 that includes a plurality of sheet trays 44.

In an upper portion of the image forming apparatus 100T is a tandem image forming device 71 in which image forming units 78Y, 78M, 78C, and 78K are aligned to form toner images, which is transferred onto an intermediate transfer body before being transferred onto a recording medium. Specifically, the image forming unit 78Y forms a toner image of yellow (Y). The image forming unit 78M forms a toner image of magenta (M). The image forming unit 78C forms a toner image of cyan (C). The image forming unit 78K forms a toner image of black (K).

An endless intermediate transfer belt 70, as an intermediate transfer body, is located in the vicinity of a center of the image forming apparatus 100T. The intermediate transfer belt 70 is entrained around and supported by a plurality of support rollers 74, 75A, 75B, 76A, and the like. The intermediate transfer belt 70 is rotatable in a clockwise direction in FIG. 2.

A belt cleaner 77 is disposed downstream from the support roller 76A (hereinafter referred to as a secondary transfer opposed roller 76A) in a direction of rotation of the intermediate transfer belt 70 to clean the intermediate transfer belt 70. Specifically, the belt cleaner 77 removes residual toner from the intermediate transfer belt 70 after a secondary transfer process. The residual toner is toner failed to be transferred from the intermediate transfer belt 70 onto a sheet as a recording medium in the secondary transfer process and therefore remaining on the intermediate transfer belt 70.

Above the intermediate transfer belt 70 stretched taut between the support roller 74 and the support rollers 75A and 75B are the four image forming units 78Y, 78M, 78C, and 78K aligned in the direction of rotation of the intermediate transfer belt 70.

The four image forming units 78Y, 78M, 78C, and 78K thus aligned laterally constitute the tandem image forming device 71 described above. The image forming units 78Y, 78M, 78C, and 78K of the tandem image forming device 71 include photoconductor drums 21Y, 21M, 21C, and 21K, respectively. The photoconductor drums 21Y, 21M, 21C, and 21K function as image bearers that bear yellow, magenta, cyan, and black toner images, respectively.

As illustrated in FIG. 2, two exposure devices 72A and 72B are disposed above the tandem image forming device 71. Specifically, the exposure device 72A is disposed to expose the image forming units 78Y and 78M. On the other hand, the exposure device 72B is disposed to expose the image forming units 78C and 78K. Each of the exposure devices 72A and 72B employs an optical scanning system and includes, e.g., a light source device, a coupling optical system, a common light deflector such as a polygon mirror, and a dual-system scanning image forming optical system. The light source device includes, e.g., a semiconductor laser, a semiconductor laser array, or a multi-beam light source. According to image data of yellow and magenta, the exposure device 72A exposes the photoconductor drums 21Y and 21M, respectively, to form an electrostatic latent image thereon. Similarly, according to image data of cyan and black, the exposure device 72B exposes the photoconductor drums 21C and 21K, respectively, to form an electrostatic latent image thereon.

Each of the photoconductor drums 21Y, 21M, 21C, and 21K is surrounded by various pieces of equipment in the image forming units 78Y, 78M, 78C, and 78K, respectively. Specifically, the photoconductor drum 21 is surrounded by, e.g., a charger, a developing device, and a photoconductor cleaner. The charger uniformly charges the surface of the photoconductor drum 21. Then, the exposure device 72 exposes the photoconductor drum 21 to form an electrostatic latent image thereon. The developing device develops the electrostatic latent image with toner, thereby forming a toner image on the surface of the photoconductor drum 21. The photoconductor cleaner removes residual toner from the surface of the photoconductor drum 21 after a primary transfer process. The residual toner is toner failed to be transferred onto the intermediate transfer belt 70 in the primary transfer process and therefore remaining on the surface of the photoconductor drum 21.

In addition, primary transfer rollers 62Y, 62M, 62C, and 62K are disposed opposite the respective photoconductor drums 21Y, 21M, 21C, and 21K via the intermediate transfer belt 70. Thus, a primary transfer area is formed between the intermediate transfer belt 70 and each of the photoconductor drums 21Y, 21M, 21C, and 21K. At the primary transfer area, a toner image is transferred from the photoconductor drum 21 onto the intermediate transfer belt 70. The primary transfer rollers 62Y, 62M, 62C, and 62K function as primary transfer device.

Among the plurality of support rollers 74, 75A, 75B, and 76A that supports the intermediate transfer belt 70 from inside a loop formed by the intermediate transfer belt 70, the support roller 74 is a driving roller that drives and rotates the intermediate transfer belt 70. The support roller 74 is coupled to a motor through a driving force transmitter (e.g., a gear, a pulley, and a belt). In a print job to form a black toner image (i.e., single color toner image) on the intermediate transfer belt 70, a transfer mechanism moves the support rollers 75A and 75B, other than the support roller 74, to separate the photoconductor drums 21Y, 21M, and 21C from the intermediate transfer belt 70. In addition to the plurality of support rollers 74, 75A, 75B, and 76A, a backup roller 63 is disposed to support the intermediate transfer belt 70 from outside the loop formed by the intermediate transfer belt 70.

A secondary transfer device 73 is disposed opposite the tandem image forming device 71 via the intermediate transfer belt 70. In the present example of FIG. 2, the secondary transfer device 73 includes a secondary transfer roller 76B pressed against the secondary transfer opposed roller 76A via the intermediate transfer belt 70. The secondary transfer roller 76B generates a transfer electric field to secondarily transfer the toner image from the intermediate transfer belt 70 onto the sheet as a sheet-shaped recording medium.

Downstream from the secondary transfer device 73 in a sheet conveyance direction is the fixing device 112 that fixes the toner image onto the sheet. A conveyor belt 38 supported by two rollers 37 conveys the sheet bearing the toner image from the secondary transfer device 73 to the fixing device 112. Instead of the conveyor belt 38, a stationary guide, a conveyor roller, or the like may be used.

In the present example of FIG. 2, a reverse device 39 is disposed below the tandem image forming device 71, the secondary transfer device 73, and the fixing device 112. The reverse device 39 reverses and conveys the sheet for duplex printing to print another toner image on a back side of the sheet, that is, to print toner images on both sides of the sheet.

To provide a fuller understanding of the embodiments of the present disclosure, a description is now given of an image forming operation together with conveyance of the sheet in the image forming apparatus 100T, with continued reference to FIG. 2.

Initially, one of sheet feeding rollers 42 incorporated in the sheet feeding table 200 is selectively rotated to pick up and feed a sheet from one of the plurality of sheet trays 44 layered in a paper bank 43. A separation roller 45 separates the sheet from other sheets resting on the sheet tray 44 and feeds the sheet to a first sheet conveyance passage 46. At least one of a plurality of conveyor roller pairs 47 conveys the sheet along the first sheet conveyance passage 46 to a second sheet conveyance passage 48, defined by some internal components of the image forming apparatus 100T. The sheet conveyed along the second sheet conveyance passage 48 strikes a registration roller pair 49 as a positioning roller pair, which halts the sheet temporarily.

Instead of feeding the sheet from the sheet feeding table 200, a sheet can be manually imported into the image forming apparatus 100T by use of a bypass feeder 51, on which a plurality of sheets can be placed. A sheet feeding roller 50 is rotated to pick up a sheet from the bypass feeder 51 and send the sheet to a separation roller 52. The separation roller 52 sends the sheet to a bypass conveyance passage 53 one by one. Like the sheet conveyed from the sheet feeding table 200, the sheet conveyed from the bypass feeder 51 comes into contact with the registration roller pair 49 and stops temporarily.

Then, activation of the registration roller pair 49 is timed to convey the sheet toward an area of contact, herein referred to as a secondary transfer area, between the intermediate transfer belt 70 and the secondary transfer roller 76B such that the sheet meets a toner image (e.g., full color toner image or single color toner image) on the intermediate transfer belt 70. It is to be noted that the full color toner image is constructed of yellow, magenta, cyan, and black toner images superimposed one atop another while being transferred from the respective photoconductor drums 21Y, 21M, 21C, and 21K onto the intermediate transfer belt 70 in the primary transfer process. Thus, a toner image is formed on the sheet. In the present example, the yellow, magenta, cyan, and black toner images are collectively transferred from the intermediate transfer belt 70 onto the sheet. Thus, a full color toner image is formed on the sheet.

Then, the conveyor belt 38 conveys the sheet bearing the toner image to the fixing device 112. The fixing device 112 fixes the toner image onto the sheet under heat and pressure. The sheet bearing the fixed toner image is conveyed to an ejection roller 56. The ejection roller 56 ejects the sheet onto an output tray 57. Thus, a plurality of sheets rest on the output tray 57 one by one in layers.

Upon duplex printing, after the toner image is fixed onto one side (i.e., front side) of the sheet, the sheet bearing the fixed toner image is directed to the reverse device 39, which reverses the sheet. The sheet is then directed to the secondary transfer area again. At the secondary transfer area, another toner image is transferred from the intermediate transfer belt 70 onto the other side (i.e., back side) of the sheet. The sheet is then conveyed to the fixing device 112, which fixes the other toner image onto the other side of the sheet. The sheet bearing the toner images on both sides thereof is then conveyed to the ejection roller 56, which ejects the sheet onto the output tray 57.

Figure 3:
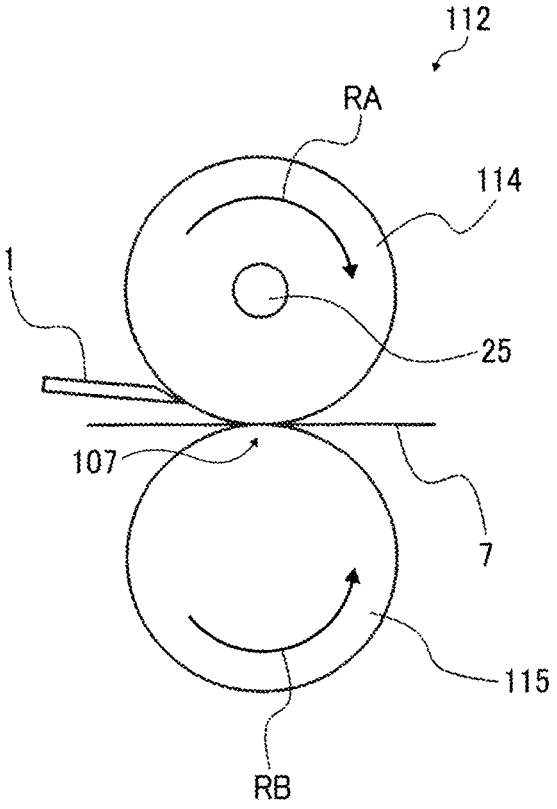
FIG. 3 is a schematic view of a fixing device incorporated in the image forming apparatus of FIG. 1 or 2.

Referring now to FIG. 3, a description is given of the fixing device 112 incorporated in the image forming apparatus 100 or 100T described above.

FIG. 3 is a schematic view of the fixing device 112 incorporating a separator 1.

The fixing device 112 of FIG. 3 employs a heat roller system. The fixing device 112 includes, e.g., the fixing roller 114 as a fixing rotator, the pressure roller 115 as a pressure rotator, and the separator 1. The heater 25 is embedded in the fixing roller 114. In the present example, the heater 25 is constructed of a plurality of heaters. Alternatively, the heater 25 may be a single heater.

As illustrated in FIG. 3, the fixing roller 114 rotates in a direction of rotation RA. On the other hand, the pressure roller 115 rotates in a direction of rotation RB. The pressure roller 115 contacts the fixing roller 114 to form a fixing nip 107 between the fixing roller 114 and the pressure roller 115, through which a recording medium (e.g., sheet 7) is conveyed. The separator 1 is disposed near the fixing nip 107.

Typically, separators often include a metal base with a resin sheet attached. In some separators, the resin sheet attached to the metal sheet is shorter than the metal base in a longitudinal direction thereof. That is, the resin sheet is attached to the metal base to expose metal portions from opposed ends of the metal base.

However, in such a configuration, heat may repeat contraction and expansion of the resin sheet. As a consequence, an adhesive that attaches the resin sheet to the metal base may come out of an end of the resin sheet, allowing a contaminant to adhere to the adhesive. Consequently, the resin sheet may be peeled from the metal base upon thermal expansion. For the same reasons, at a boundary between the base metal and a portion of the resin sheet unattached to the metal base, an end of the resin sheet may be deformed. As a consequence, the resin sheet may float. If such a resin of the separator contacts a recording medium bearing a toner image, the image quality may be degraded. If the resin sheet is pressed outwards in a longitudinal direction thereof while being attached to the metal base, the adhesive between the metal base and the resin sheet may come out of an end of the resin sheet. As a consequence, faulty conveyance of a recording medium may occur, such as a paper jam.

Thus, typical separators hardly withstand use over a relatively long period of time.

Hence, according to the embodiments, a durable separator (e.g., separator 1) is provided that can withstand use over a relatively long period of time.

Referring back to FIG. 3, the separator 1 is disposed in contact with or adjacent to the fixing roller 114, so as to separate the recording medium from the fixing roller 114 after the recording medium passes through the fixing nip 107. Alternatively, the separator 1 may be disposed in contact with or adjacent to the pressure roller 115, so as to separate the recording medium from the pressure roller 115 after the recording medium passes through the fixing nip 107.

Referring now to FIGS. 4A through 11, a detailed description is given of the separator 1.

The separator includes a base 1A and a resin sheet 1B. The base 1A has a tapered shape (hereinafter referred to as a tapered portion T) all along a longitudinal direction thereof, which is also a longitudinal direction of the separator 1. In other words, the base 1A has an overall length provided with the tapered portion T, to be adjacent to the fixing nip 107 without interrupting the fixing roller 114.

Figure 4B:
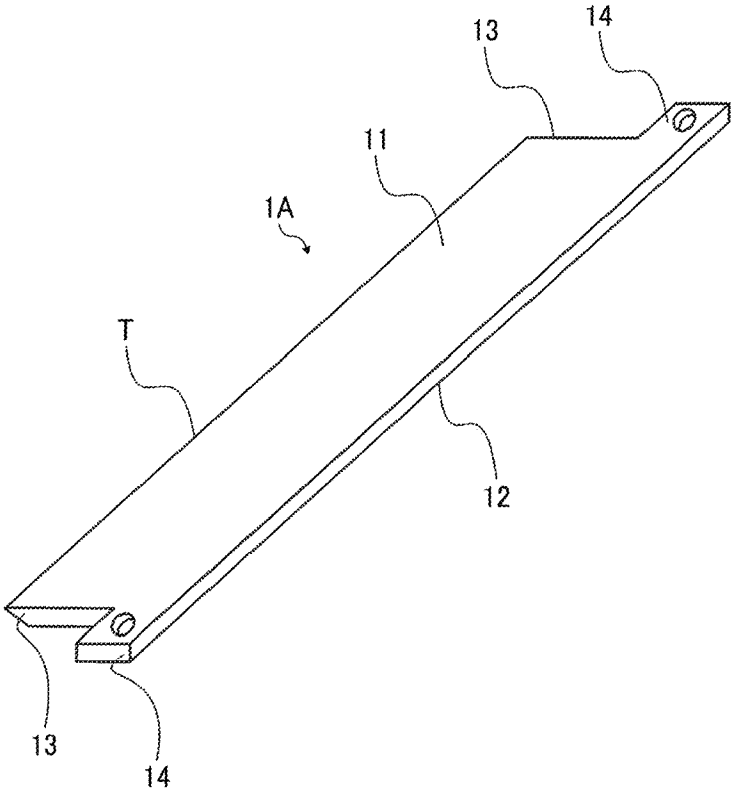
FIG. 4B is a perspective view of the base of the separator incorporated in the fixing device of FIG. 3, illustrating a first face side of the base.
Figure 4A:
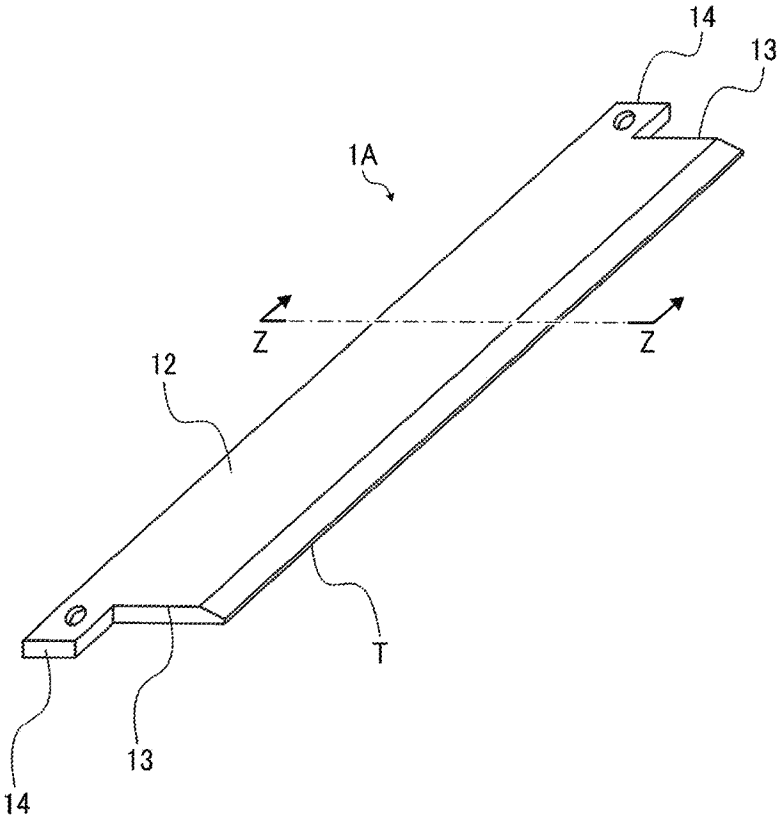
FIG. 4A is a perspective view of a base of a separator incorporated in the fixing device of FIG. 3, illustrating a second face side of the base.

FIGS. 4A and 4B are perspective views of the base 1A of the separator 1. Specifically, FIG. 4A is a perspective view of the base 1A of the separator 1, illustrating a second face side of the base 1A. FIG. 4B is a perspective view of the base 1A of the separator 1, illustrating a first face side of the base 1A.

The base 1A includes the tapered portion T, a first face 11, a second face 12, a third face 13, and a holder 14. The tapered portion T is adjacent to the fixing roller 114. The first face 11 faces the recording medium (e.g., sheet 7). The second face 12 is opposite to the first face 11. In the present example, the second face 12 faces the fixing roller 114 of FIG. 3. The third face 13 is an end face of the base 1A in the longitudinal direction thereof. The holder 14 is held by a side plate. The third face 13 may be an edge, instead of a surface. To enhance durability of the resin sheet 1B, the third face 13 is a surface in the present example.

Figure 5:
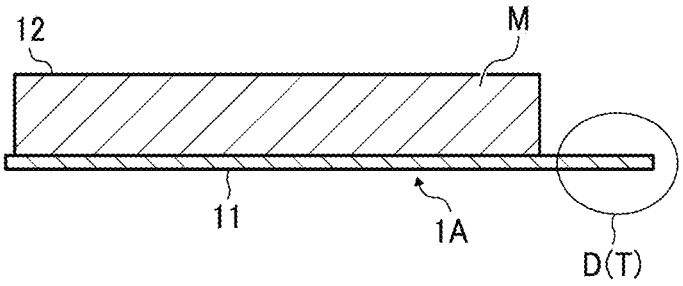
FIG. 5 is an enlarged view of an end of the base of the separator.

The tapered portion T is formed by, e.g., chamfering an end of the base 1A. Alternatively, as illustrated in FIG. 5, a sheet-shaped metal board M may be attached to the base 1A by, e.g., welding, to form a step shape or step portion D.

Figure 6:
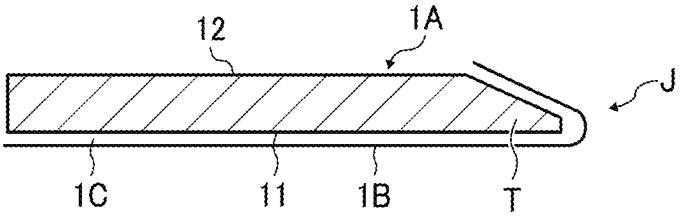
FIG. 6 is a cross-sectional view of the separator.

FIG. 6 is a cross-sectional view of the separator 1 along a line Z illustrated in FIG. 4A.

The resin sheet 1B is attached to the base 1A, covering substantially an entire area of the first face 11 and the tapered portion T via a turning portion J. An adhesive layer 1C is interposed between the base 1A and the resin sheet 1B to stick the base 1A and the resin sheet 1B together. The adhesive layer 1C does not include bubbles to prevent the resin sheet 1B from being peeled from the base 1A and to prevent an uneven height of the separator 1, thereby contributing to good image quality.

Specifically, in the present example, the resin sheet 1B is attached onto the base 1A with an adhesive and pressed against the base 1A by a roller, thereby forming the adhesive layer 1C between the base 1A and the resin sheet 1B to stick the base 1A and the resin sheet 1B together. Alternatively, a thermosetting adhesive may be used to stick the base 1A and the resin sheet 1B together under heat and pressure.

Figure 7B:
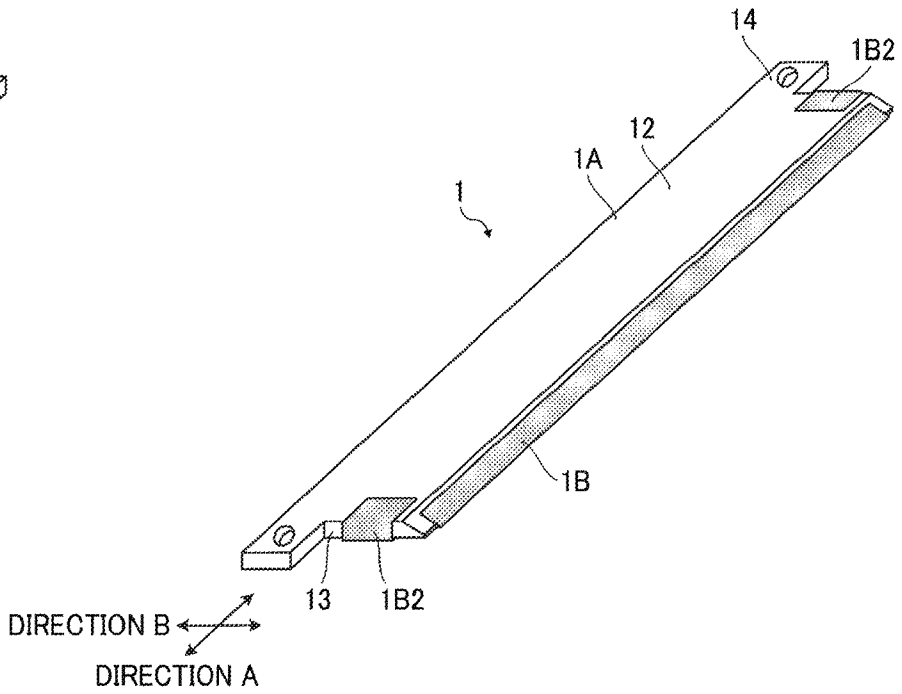
FIG. 7B is a perspective view of the base of the separator with the resin sheet attached, illustrating the second face side of the base.
Figure 7A:
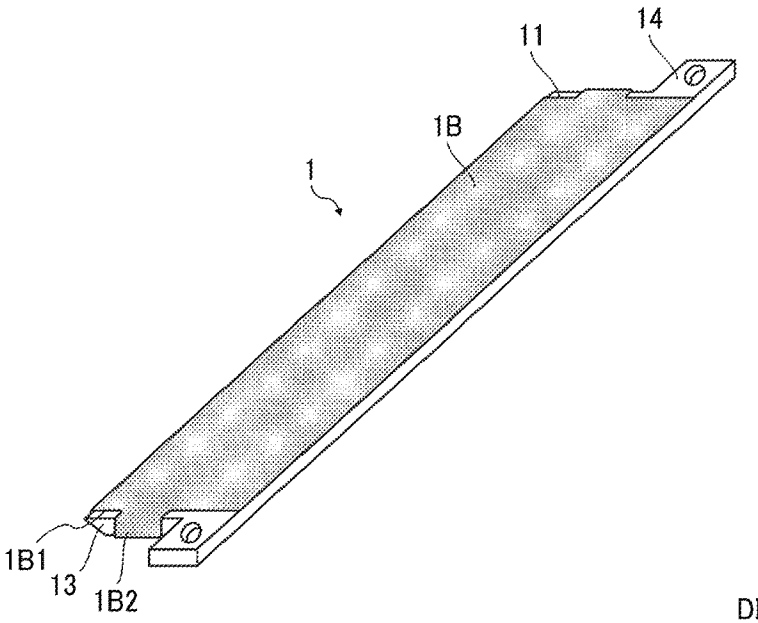
FIG. 7A is a perspective view of the base of the separator with a resin sheet attached, illustrating the first face side of the base.

FIG. 7A is a perspective view of the base 1A of the separator 1 with the resin sheet 1B attached, illustrating the first face side of the base 1A. FIG. 7B is a perspective view of the base 1A of the separator 1 with the resin sheet 1B attached, illustrating the second face side of the base 1A.

In a short direction of the separator 1, the resin sheet 1B is attached to substantially an entire area of the base 1A in a short direction thereof, that is, the short direction of the separator 1, so as not to rub the medium. A length of the base 1A in the short direction thereof may obviate the resin sheet 1B from being attached to substantially the entire area of the base 1A in the short direction thereof. In other words, the resin sheet 1B may be attached to a smaller area of the base 1A than the entire area of the base 1A in the short direction thereof, provided that the recording medium does not directly contact the base 1A.

On the other hand, the resin sheet 1B includes a first end portion 1B1 and a projecting portion 1B2 at each of opposed end portions of the resin sheet 1B in a longitudinal direction thereof, that is, the longitudinal direction of the separator 1.

Initially, a description is given of the first end portion 1B1 of the resin sheet 1B.

A length between the first end portions 1B1 at one end portion of the resin sheet 1B to the first end portion 1B1 at the other end portion of the resin sheet 1B, herein referred to as a width of the resin sheet 1B, is preferably equal to a length of the base 1A in the longitudinal direction thereof. In other words, the resin sheet 1B has a length in the longitudinal direction thereof substantially equal to a length of the base 1A in the longitudinal direction thereof.

Considering accuracy of parts and construction methods, the resin sheet 1B may sometimes hard to have a width equal to the length of the base 1A in the longitudinal direction thereof. To address this circumstance, the width of the resin sheet 1B may be not less than a maximum width of a recording medium that can be conveyed in the fixing device 112, while being smaller than the length of the base 1A in the longitudinal direction thereof. In other words, the length of the resin sheet 1B in the longitudinal direction thereof is not less than a maximum width of the medium, and not greater than the length of the base 1A in the longitudinal direction thereof.

Figure 8A:
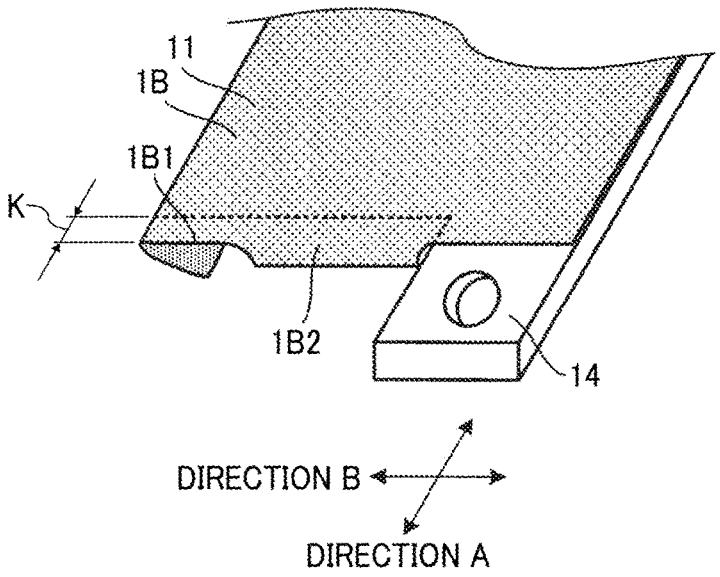
FIG. 8A is a perspective view of an end of the separator.

Depending on the maximum width of the recording medium and a width of the separator 1, the resin sheet 1B may hardly have a width not less than the maximum width of the recording medium that can be conveyed in the fixing device 112, while being smaller than the length of the base 1A in the longitudinal direction thereof. To address this circumstance, as illustrated in FIG. 8A, the resin sheet 1B may be attached to the base 1A such that the width of the resin sheet 1B is greater than the length of the base 1A in the longitudinal direction thereof by a length K. The length K of the resin sheet 1B is a length outboard from an end of the base 1A in the longitudinal direction thereof and shorter than the projecting portion 1B2, described later, in a direction A. In other words, the length of the resin sheet 1B in the longitudinal direction thereof is greater than the length of the base 1A in the longitudinal direction thereof by the length K, which is less than a length of the projecting portion 1B2 in the longitudinal direction of the resin sheet 1B.

Figure 8B:
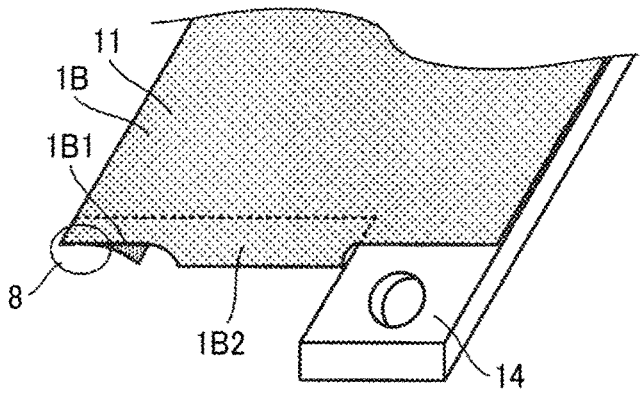
FIG. 8B is a perspective view of the end of the separator with an overlapping portion.

In such a case, an overlapping portion 8 is formed as illustrated in FIG. 8B. Specifically, adhesive surfaces of the first end portion 1B1 for the length K adhere to each other to form the overlapping portion 8 outboard from an end portion of the tapered portion T in the longitudinal direction of the base 1A. The overlapping portion 8 prevents the resin sheet 1B adhering to the second face 12 of the base 1A from being peeled therefrom. To reduce an amount of the resin sheet 1B to be used, the length K and the overlapping portion 8 are preferably minimized.

Now, a description is given of the projecting portion 1B2 of the resin sheet 1B.

The projecting portion 1B2 is longer than the base 1A in the longitudinal direction thereof. That is, the projecting portion 1B2 projects beyond an end of the base 1A in the longitudinal direction thereof. The projecting portion 1B2 is turned toward the second face 12 of the base 1A, thus being attached to the second face 12 via the third face 13. If the resin sheet 1B is stretched, but is not extended, while being attached to the second face 12, the resin sheet 1B can be attached to the second face 12 without producing any gap between the resin sheet 1B and the base 1A or floating on the base 1A.

Preferably, the projecting portion 1B2 is positioned not to interrupt a portion of the resin sheet 1B that covers the tapered portion T of the base 1A. Specifically, the projecting portion 1B2 is positioned downstream from the tapered portion T of the base 1A in the sheet conveyance direction. If an adhesive surface of the projecting portion 1B2 is divided into a portion that contacts the second face 12 of the base 1A and a portion that contacts the portion of the resin sheet 1B covering the tapered portion T of the base 1A, the adhesive surface of the projecting portion 1B2 may have a step thereon. Such a step on the adhesive surface of the projecting portion 1B2 may easily peel the projecting portion 1B2 from the base 1A. To address this circumstance, in the present embodiment, the projecting portion 1B2 is positioned downstream from the tapered portion T of the base 1A in the sheet conveyance direction.

The direction A, described above, is a width direction of the sheet, and also an axial direction of the base 1A. On the other hand, a direction B is the sheet conveyance direction, and also the short direction of the base 1A. To reliably turn and attach the projecting portion 1B2 of the resin sheet 1B onto the second face 12, the length of the projecting portion 1B2 in the direction A or in the longitudinal direction of the resin sheet 1B is not less than twice a thickness of the third face 13 of the base 1A. More preferably, the length of the projecting portion 1B2 in the direction A is three or more times greater than the thickness of the third face 13. For example, if the third face 13 has a thickness of about 1.2 mm, the projecting portion 1B2 of the resin sheet 1B has a length of about 5 mm in the direction A.

Figure 9:
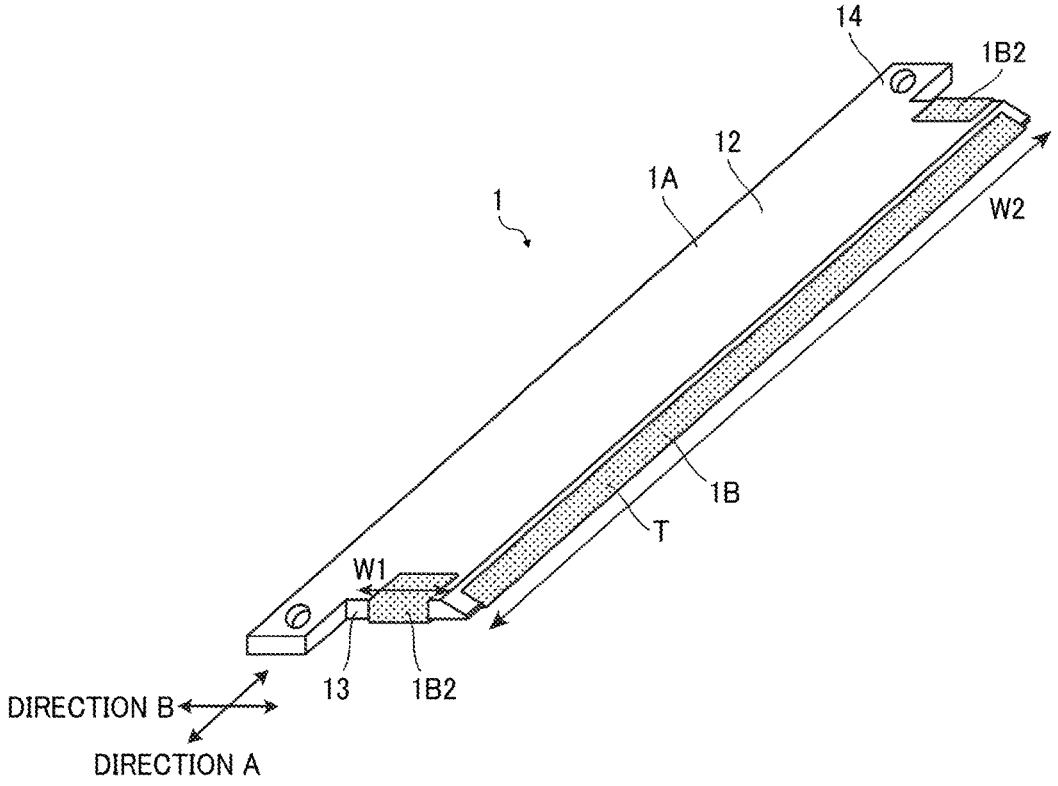
FIG. 9 is a perspective view of the base of the separator with the resin sheet attached, illustrating width in some directions.

On the other hand, the projecting portion 1B2 of the resin sheet 1B may have a length in the direction B equal to a width W1 of the base 1A illustrated in FIG. 9, for example. Taking into account component accuracy, the length of the projecting portion 1B2 of the resin sheet 1B in the direction B is determined so as not to interrupt the holder 14 or the tapered portion T of the base 1A. In the present embodiment, the projecting portion 1B2 of the resin sheet 1B is separated from the holder 14 and the tapered portion T of the base 1A at a distance not less than about 1 mm. However, each of the distance between the projecting portion 1B2 of the resin sheet 1B and the holder 14 of the base 1A and the distance between the projecting portion 1B2 of the resin sheet 1B and the tapered portion T of the base 1A is not limited to the distance not less than about 1 mm. Alternatively, the projecting portion 1B2 of the resin sheet 1B may be distanced from the holder 14 and the tapered portion T of the base 1A farther, provided that the projecting portion 1B2 is not peeled from the base 1A.

As illustrated in FIG. 9, the width W1 of the base 1A is a length in the short direction thereof, from an upstream base position of the holder 14 in the sheet conveyance direction to a base of the tapered portion T. On the other hand, a width W2 of the base 1A is a length in the longitudinal direction thereof or in the axial direction thereof excluding a length of the holder 14 in the axial direction of the base 1A.

According to the separator 1 of the present embodiment described above, a part of the sheet (e.g., resin sheet 1B) is longer than the width W2 of the base 1A in the longitudinal direction thereof. Such a configuration prevents the sheet from being peeled from the base (e.g., base 1A), further preventing the adhesive peeking out between the sheet and the base even if the sheet is deformed by heat or overtime, because the sheet receives a force in the longitudinal direction thereof. In addition, such a configuration shortens the length of the base in the axial direction thereof compared to a configuration in which the base is exposed.

That is, even if the first end portion 1B1 of the resin sheet 1B is deformed by heat, the projecting portion 1B2 attached to the second face 12 of the base 1A described above prevents the resin sheet 1B from floating or being contracted, because the resin sheet 1B receives a force in the longitudinal direction thereof with the projecting portion 1B2.

Figure 10A:
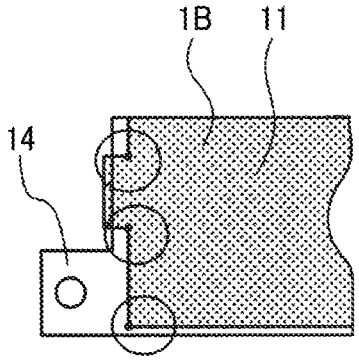
FIG. 10A is an enlarged view of an end of the separator, from the first face side of the base.
Figure 10B:
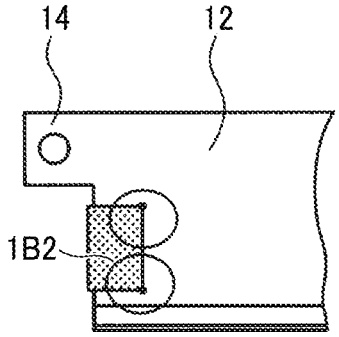
FIG. 10B is an enlarged view of the end of the separator, from the second face side of the base.
Figure 11:
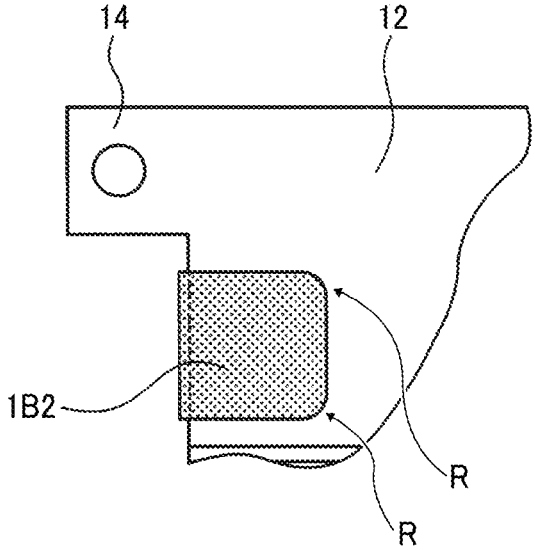
FIG. 11 is an enlarged view of the end of the separator, from the second face side of the base, illustrating round corners of the resin sheet.

Referring now to FIGS. 10A through 11, a further description of the projecting portion 1B2 of the resin sheet 1B.

FIG. 10A is an enlarged view of an end of the separator 1, from the first face side of the base 1A. FIG. 10B is an enlarged view of the end of the separator 1, from the second face side of the base 1A. FIG. 11 is an enlarged view of the end of the separator 1, from the second face side of the base 1A, illustrating round corners of the resin sheet 1B.

Specifically, FIG. 10A illustrates the resin sheet 1B attached onto the first face 11 of the base 1A, circling square corners of the resin sheet 1B. On the other hand, FIG. 10B illustrates the projecting portion 1B2 of the resin sheet 1B attached onto the second face 12 of the base 1A, circling square corners of the projecting portion 1B2. In particular, the square corners of the projecting portion 1B2 have a less adhesive area than another adhesive area of the projecting portion 1B2 adhering to the second face 12 of the base 1A. To address this circumstance, according to the present embodiment, the resin sheet 1B may have the square corners chamfered, or may have round corners R instead of square corners, as illustrated in FIG. 11. The chamfered corners or the round corners R remove such a less adhesive area of the square corners from the resin sheet 1B, thereby preventing the resin sheet 1B from being peeled from the base 1A.

Now, a further description is given of the base 1A, the resin sheet 1B, and the adhesive layer 1C, regarding the material, thickness, and the like.

The base 1A is made of, e.g., iron, aluminum, copper, or stainless steel. The base 1A has a thickness of from about 50 μm to about 300 μm. A base having a thickness less than about 50 μm may not be able to apply pressure to, e.g., a roller to reliably separate a recording medium from the roller. By contrast, a base having a thickness greater than about 300 μm may cause the sheet to abut against an edge of the separator, which may fail to separate the sheet from the roller, causing a paper jam.

The resin sheet 1B has a thickness of from about 10 μm to about 200 μm, and more preferably, from about 40 μm to about 80 μm. A resin sheet having a thickness less than about 10 μm may be broken by friction against a developer. Even a slight attrition of such a thin resin sheet may expose the metal base 1A. In addition, such a thin resin sheet may be easily wrinkled while being attached to the metal base 1A, causing difficulty in handling the resin sheet. By contrast, a resin sheet having a thickness greater than about 200 μm may degrade separability of recording media from the roller.

The resin sheet 1B is a fluororesin sheet made of, e.g., polytetrafluoroethylene (PTFE), tetrafluoroethylene-perfluoroalkylvinylether copolymer (PFA), tetrafluoroetylene-hexafluoropropylen copolymer (FEP), ethylenetetrafluoroethylene (ETFE), polychlorotrifluoroethylene, chlorotrifluoroethylene-ethylene copolymer, polyvinylidene fluoride, polyvinyl fluoride, or tetrafluoroetylene-hexafluoropropylen-perfluoroalkylvinylether copolymer.

In particular, a fluororesin sheet made of PTFE, PFA, FEP, or ETFE is suitable for the separator 1 because such a fluororesin sheet has poor adhesiveness with respect to a developer and good heat resistance. It is to be noted that a sheet made of fluororesin mixed with fine carbon powder, such as ketjen black or acetylene black, prevents degradation of separability of recording media from the roller caused by static electricity.

The adhesive used between the base 1A and the resin sheet 1B is, e.g., an adhesive obtained by condensing a diorganopolysiloxane gum and a copolymer of an $SiO_2$ unit and a $(CH_3)_3SiO$ unit, for example. Such a silicone adhesive tightly attaches the resin sheet 1B onto the base 1A. In particular, the silicone adhesive maintains an efficacious adhesiveness with respect to a fixing temperature at which a toner image is fixed onto a recording medium. In addition, by use of the silicon adhesive, the adhesive layer 1C between the resin sheet 1B and the base 1A can be relatively thin. With such a thin layer of the silicone adhesive, the separator 1 has a thickness that maintains good separability of recording media from the roller. In other words, with the thin adhesive layer 1C, the separator 1 is not so thick that the separator 1 loses a separation function thereof.

For example, the adhesive layer 1C made of silicone has a thickness of from about 5 μm to about 50 μm. A silicone adhesive layer having a thickness less than about 5 μm may not be able to obtain efficacious adhesiveness sufficiently. By contrast, with a silicone adhesive layer having a thickness greater than about 50 μm, the separator 1 might have a relatively large thickness, degrading separability of recording media from the roller.

Preferably, a combined thickness of the resin sheet 1B and the adhesive layer 1C is from about 50 μm to about 200 μm.

In the present embodiment, the separator 1 is used to separate a recording medium (e.g., sheet 7) from a fixing rotator, such as a fixing roller (e.g., fixing roller 114), disposed inside an electrophotographic apparatus (e.g., image forming apparatuses 100 or 100T). The fixing rotator is not limited to a fixing roller. Alternatively, the fixing rotator may be a fixing belt. At least the surface of the fixing rotator is heated to fix a toner image on the recording medium. The separator 1 can be used not only for the fixing device of the electrophotographic apparatus as described above, but also for, e.g., an inkjet or a prepreg process, in which a medium passes through opposed rollers, to separate the medium from one of the opposed rollers.

It is to be noted that in the description above, a "length in a longitudinal direction" and a "width" have identical definitions.

According to the embodiments described above, a durable separator (e.g., separator 1) is provided that can withstand use over a relatively long period of time.

Although the present disclosure makes reference to specific embodiments, it is to be noted that the present disclosure is not limited to the details of the embodiments described above and various modifications and enhancements are possible without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Any one of the above-described operations may be performed in various other ways, for example, in an order different from that described above.

What is claimed is:

1. A separator for separating a medium from a rotator, the separator comprising:

a base including:

a first face to face the medium;

a second face being opposite to the first face; and a third face being an end face in a longitudinal direction of the base; and a sheet disposed on a portion of each of the first face and the second face that contacts or is adjacent to the rotator, the sheet having a length in a longitudinal direction of the sheet substantially equal to a length of the base in the longitudinal direction of the base, the sheet including a projecting portion outboard from the length of the sheet in the longitudinal direction of the sheet, a combined length of the sheet and the projecting portion in the longitudinal direction of the sheet being greater than the length of the base in the longitudinal direction of the base, the projecting portion being attached to the second face and the third face of the base.

2. The separator according to claim 1, wherein the length of the sheet in the longitudinal direction of the sheet is not less than a maximum width of the medium; and wherein the length of the sheet in the longitudinal direction of the sheet is not greater than the length of the base in the longitudinal direction of the base.

3. The separator according to claim 1, wherein the length of the sheet in the longitudinal direction of the sheet is greater than the length of the base in the longitudinal direction of the base by a length less than a length of the projecting portion in the longitudinal direction of the sheet.

4. The separator according to claim 1, wherein a length of the projecting portion in the longitudinal direction of the sheet is not less than twice a thickness of the third face of the base.

5. The separator according to claim 1, further comprising an adhesive layer between the base and the sheet to stick the base and the sheet together, wherein the sheet is a fluororesin sheet, and wherein a combined thickness of the sheet and the adhesive layer is from about 50 μm to about 200 μm.

6. A fixing device comprising:

a fixing rotator;

a pressure rotator to contact the fixing rotator to form a fixing nip between the fixing rotator and the pressure rotator, through which a recording medium bearing a toner image is conveyed; and a separator disposed in contact with or adjacent to one of the fixing rotator and the pressure rotator, to separate the recording medium from the one of the fixing rotator and the pressure rotator, the separator comprising:

a base including:

a first face to face the recording medium;

a second face being opposite to the first face; and a third face being an end face in a longitudinal direction of the base; and a sheet disposed on a portion of each of the first face and the second face that contacts or is adjacent to the one of the fixing rotator and the pressure rotator, the sheet having a length in a longitudinal direction of the sheet substantially equal to a length of the base in the longitudinal direction of the base, the sheet including a projecting portion outboard from the length of the sheet in the longitudinal direction of the sheet, a combined length of the sheet and the projecting portion in the longitudinal direction of the sheet being greater than the length of the base in the longitudinal direction of the base, the projecting portion being attached to the second face and the third face of the base.

7. The fixing device according to claim 6, further comprising a heater to heat at least a surface of the fixing rotator, wherein the fixing rotator is one of a roller and a belt.

8. An image forming apparatus comprising:

an image bearer to bear a toner image; and a fixing device to fix the toner image on a recording medium, the fixing device comprising:

a fixing rotator;

a pressure rotator to contact the fixing rotator to form a fixing nip between the fixing rotator and the pressure rotator, through which the recording medium is conveyed; and a separator disposed in contact with or adjacent to one of the fixing rotator and the pressure rotator, to separate the recording medium from the one of the fixing rotator and the pressure rotator, the separator comprising:

a base including:

a first face to face the recording medium;

a second face being opposite to the first face; and a third face being an end face in a longitudinal direction of the base; and a sheet disposed on a portion of each of the first face and the second face that contacts or is adjacent to the one of the fixing rotator and the pressure rotator, the sheet having a length in a longitudinal direction of the sheet substantially equal to a length of the base in the longitudinal direction of the base, the sheet including a projecting portion outboard from the length of the sheet in the longitudinal direction of the sheet, a combined length of the sheet and the projecting portion in the longitudinal direction of the sheet being greater than the length of the base in the longitudinal direction of the base, the projecting portion being attached to the second face and the third face of the base.

9. The image forming apparatus according to claim 8, wherein the fixing device further includes a heater to heat at least a surface of the fixing rotator, and wherein the fixing rotator is one of a roller and a belt.

* * * * *